US010260759B2

(12) United States Patent
Colozzo et al.

(10) Patent No.: US 10,260,759 B2
(45) Date of Patent: Apr. 16, 2019

(54) HOUSEHOLD COOKING APPLIANCE

(71) Applicant: WHIRLPOOL EMEA S.P.A., Pero (MI) (IT)

(72) Inventors: Vincenzo Giuseppe Colozzo, Gualdo Tadino (IT); Fabio Gambardella, Catanzaro Lido (IT); Matteo Scoponi, Civitanova Marche (IT)

(73) Assignee: Whirlpool EMEA S.p.A, Pero (MI) (IT)

( * ) Notice: Subject to any disclaimer, the term of this patent is extended or adjusted under 35 U.S.C. 154(b) by 348 days.

(21) Appl. No.: 15/029,844

(22) PCT Filed: Oct. 16, 2014

(86) PCT No.: PCT/IB2014/065364
§ 371 (c)(1),
(2) Date: Apr. 15, 2016

(87) PCT Pub. No.: WO2015/056208
PCT Pub. Date: Apr. 23, 2015

(65) Prior Publication Data

US 2016/0273780 A1 Sep. 22, 2016

(30) Foreign Application Priority Data

Oct. 18, 2013 (IT) ..... TO2013A0852

(51) Int. Cl.
*F24C 15/02* (2006.01)
*F24C 15/32* (2006.01)
(Continued)

(52) U.S. Cl.
CPC ..... *F24C 15/322* (2013.01); *F24C 15/001* (2013.01); *F24C 15/006* (2013.01); *F24C 15/02* (2013.01); *F24C 15/2007* (2013.01)

(58) Field of Classification Search
CPC .... F24C 15/006; F24C 15/04; F24C 15/2007; F24C 15/322; F24C 15/001; F24C 15/02; F24C 15/325
See application file for complete search history.

(56) References Cited

U.S. PATENT DOCUMENTS

2004/0159317 A1 8/2004 Walther et al.

FOREIGN PATENT DOCUMENTS

EP 0942235 A1 9/1999
EP 1050718 A2 8/2000
(Continued)

OTHER PUBLICATIONS

International Patent Application No. PCTIB2014065364 filed, Oct. 16, 2014, Applicant: Indesit Company S.P.A.. International Publication No. WO2015056208A1 with International Search Report dated Nov. 2, 2015 re: same.
(Continued)

*Primary Examiner* — Alfred Basichas
(74) *Attorney, Agent, or Firm* — Price Heneveld LLP

(57) ABSTRACT

A household cooking appliance, in particular an oven, comprises a cooking chamber defined by a muffle having a flue with a fume outlet at an upper wall of the muffle, and a front door, for opening and closing the cooking chamber. The appliance further comprises a delivery channel, defined by a duct body that extends above the upper wall of the muffle, the duct body having an outlet of the delivery channel that is substantially at a front region of the appliance, above an upper portion of the door, and having a fume inlet in a lower wall of the duct body, which is in fluid communication with the fume outlet of the muffle and with the delivery channel. Operatively associated to the duct body is a ventilation assembly, so as to draw in fumes from the fume outlet of the muffle and expel them from the outlet
(Continued)

of the delivery channel, the ventilation assembly being in a rear end region of the duct body that is generally opposite to the outlet of the delivery channel. The ventilation assembly comprises a radial fan with a centrifugal impeller inside the duct body, the centrifugal impeller being positioned above the fume inlet of the duct body substantially coaxial thereto and to the fume outlet of the muffle in such a way that at least the fumes are drawn in from the fume outlet substantially in the direction of the axis (X) of the impeller and forced in a radial direction into the delivery channel for being expelled from the corresponding outlet. The rear end region of the duct body has a generally rounded peripheral profile so as to form a volute of the radial fan, the duct body preferably having a shape generally tapered towards its rear end region and comprising a lower half-shell and an upper half-shell. Provided inside the duct body, within the boundaries of the delivery channel, is a flow-deflector element configured for rendering the flow forced by the centrifugal impeller into the delivery channel uniform.

18 Claims, 9 Drawing Sheets

(51) Int. Cl.
*F24C 15/00* (2006.01)
*F24C 15/20* (2006.01)

(56) References Cited

FOREIGN PATENT DOCUMENTS

| | | | | |
|---|---|---|---|---|
| EP | 1698832 | A2 | | 9/2006 |
| EP | 1795812 | A2 | | 6/2007 |
| EP | 0942235 | | * | 3/2008 |
| EP | 1972855 | A1 | | 9/2008 |

OTHER PUBLICATIONS

Italian Patent Application No. TO2013A00852, filed Oct. 18, 2013, Applicant: Indesit Company S.P.A., Written Search Opinion re: Same.

* cited by examiner

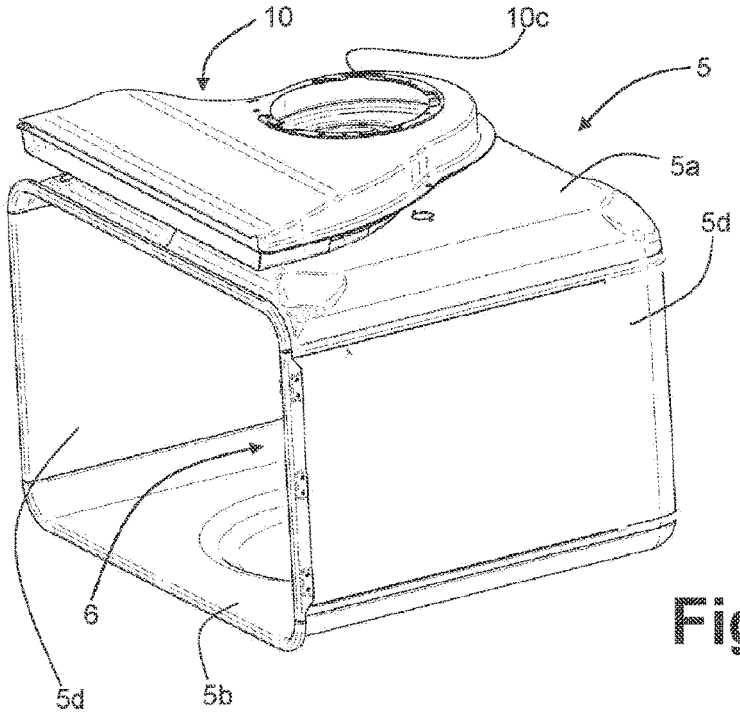
Fig. 4
Fig. 5
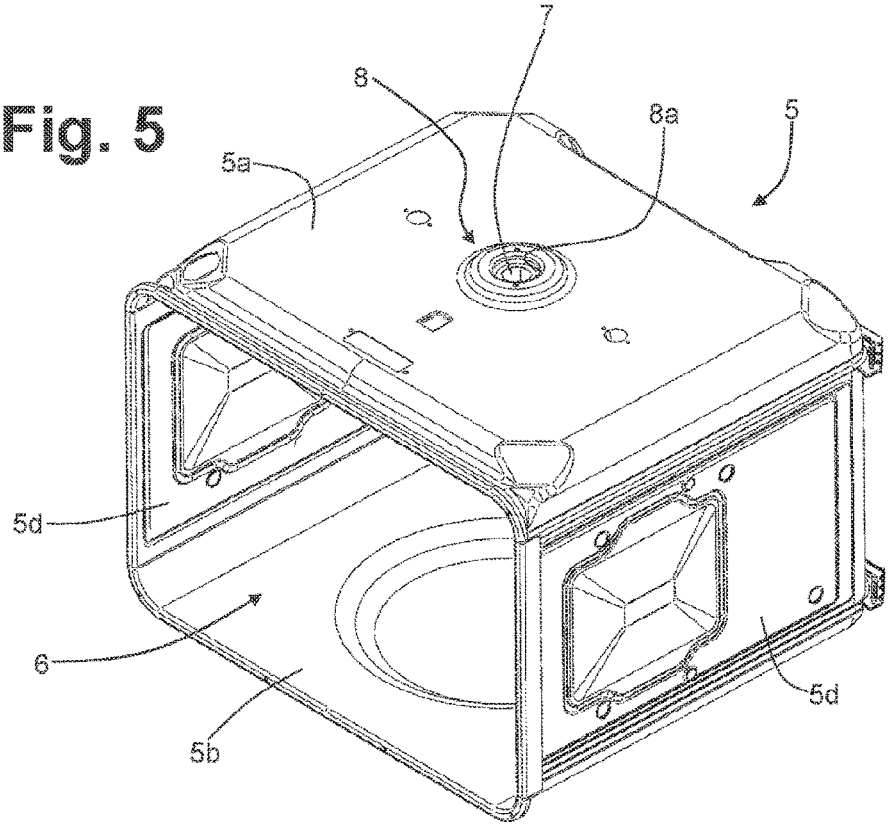

HOUSEHOLD COOKING APPLIANCE

FIELD OF THE INVENTION

The present invention relates to a household cooking appliance comprising a cooking chamber, defined by a muffle having a fume outlet at an upper wall thereof, and a front door for opening and closing the cooking chamber.

BACKGROUND

Appliances of the type referred to are known and typically constituted by cooking ovens or kitchen ranges comprising a cooking oven.

The above appliances comprise a metal load-bearing structure, which are associated with the muffle delimiting the cooking chamber and the corresponding front door. The muffle generally has an opening in its upper wall, on which a flue is mounted for expulsion of fumes from the cooking chamber. In certain solutions, extending above the upper wall of the muffle is a duct body—generally made of sheet metal—that defines a delivery channel, into which the flue gives out. The channel is shaped so as to present a corresponding outlet substantially at the front of the appliance, above an upper portion of the door. Some known ovens likewise comprise a ventilation assembly, operatively associated to a rear end of the duct body, so as to force the fumes along the delivery channel and expel them from its outlet, on the front of the appliance.

The fan used is typically a horizontal-axis tangential fan that, in certain known solutions, has a volute defining an air intake, for drawing in air into the structure of the appliance, generally from an area behind the rear wall of the muffle. In other known solutions, instead, the duct body also defines an intake channel, which extends underneath the delivery channel and has an inlet at the front of the appliance, substantially in a position corresponding to the upper portion of the door, underneath the outlet of the delivery channel. The opposite end of the intake channel is located in a position corresponding to the tangential fan: in this way, relatively fresh air can also be drawn in from outside the structure of the appliance, in its front region, in order to mix said air with the fumes that exit from the cooking chamber and thereby enable a certain abatement of their temperature, prior to their expulsion at the front of the appliance.

The aforesaid arrangement including an intake channel and a delivery channel can also be used for inducing flows of cooling air into the door of the oven, in particular when the latter has functions of pyrolytic cleaning of the cooking chamber. In solutions of this type the flue is constituted by a generally vertical tubular body, fixed to the upper wall of the muffle at an opening thereof, with the upper end of said tubular body that projects into the intake channel, at an intermediate point of the latter between its front inlet and the tangential fan. In this way, the air taken in from the front of the appliance through the inlet of the intake channel can be mixed with the fumes coming from the flue, with the resulting mixture that is then expelled via the delivery channel, once again at the front of the appliance, above the upper portion of the door. The air drawn in from the front of the appliance through the intake channel is air conveniently present in one or more gaps of the front door of the appliance, which have respective openings in an area corresponding to the upper part of the door: in this way, a continuous air change is induced in the gaps, which enables reduction of the temperature of the door as a whole. For this purpose, at the upper portion of the door deflector elements are provided, configured for shielding the inlet of the intake channel and the upper openings of the gaps of the door with respect to the outlet of the delivery channel. An arrangement of this type is known for example from US 2004/159317 A1, on which the preamble of Claim 1 is based.

Ovens of the above type, albeit on average efficient, present some drawbacks that it would be desirable to overcome.

One drawback of the known solutions is linked to the relatively distant positioning of the outlet or flue with respect to the tangential fan. In these conditions, the tangential fan is unable to generate high negative pressures in the flue, which must consequently have a rather large fume-outlet hole, with consequent dispersion of heat. This is also a consequence of the fact that the tangential fan is usually mounted in a position as retracted as possible on the upper wall of the muffle in order to also be able to draw in air from the area behind the muffle, whilst the flue must preferably be substantially located in a central area of the aforesaid upper wall in order to achieve its full effect.

A further consequence of the above known arrangement is that the duct body that defines the delivery channel, or the intake channel and the delivery channel, must extend practically from the rear area of the muffle substantially up to the front of the appliance. This arrangement, in addition to determining problems of encumbrance, implies a significant use of metal material in order to produce the duct body.

Further practical drawbacks derive from the need to couple, in the assembly step, the volute of the tangential fan, which is also usually made of metal material, to the duct body.

Another drawback regards the modalities of construction of the flue necessary for fluid connection of the cooking chamber to the delivery channel or intake channel of the duct body. The flue is formed by a tubular element relatively extensive in height, which must be mounted and fixed to the upper wall of the cooking chamber, at the outlet.

Other drawbacks are linked to a relatively low efficiency of the known systems in relation to the effect of cooling the inside structure of the oven and its door, in particular of the outermost part of the door, when this is provided with a number of gaps.

SUMMARY

In its general terms, the object of the present invention is to provide a cooking appliance that will enable one or more of the aforesaid drawbacks of the known art to be overcome in a simple and economically advantageous way. These objects are achieved, according to the present invention, by a cooking appliance having the characteristics specified in the annexed claims.

In brief, the invention relates to a household cooking appliance, in particular an oven, comprising a cooking chamber defined by a muffle having a flue with a fume outlet at an upper wall thereof, and a front door, for opening and closing the cooking chamber. The appliance comprises a delivery channel, defined by a duct body that extends over the upper wall of the muffle and that has an outlet of the delivery channel substantially at the front of the appliance, above an upper portion of the door. The channel likewise has a fume inlet in a lower wall thereof, which is in fluid communication with the fume outlet of the muffle and with the delivery channel. Operatively associated to the duct body, in particular at a corresponding opening of an upper wall thereof, is a ventilation assembly so as to draw in fumes from the fume outlet of the muffle and expel them from the outlet of the delivery channel, wherein the aforesaid ventilation assembly is in a rear end region of the duct body that is generally opposite to the outlet of the delivery channel.

According to the invention, the appliance is characterized in that:

the ventilation assembly comprises a radial fan with a centrifugal impeller inside the duct body, the centrifugal impeller being positioned above the fume inlet of the duct body substantially coaxial thereto and to the fume outlet of the muffle in such a way that at least the fumes are drawn in from the fume outlet substantially in the direction of the axis of the impeller and forced in a radial direction into the delivery channel for being expelled from the corresponding outlet; the rear end region of the duct body has a generally rounded peripheral profile so as to form a volute of the radial fan, the duct body preferably having a shape generally tapered towards its rear end region and comprising a lower half-shell and an upper half-shell; and provided inside the duct body, within the delivery channel, is a flow-deflector element configured for rendering the flow forced by the centrifugal impeller into the delivery channel uniform.

The presence of a centrifugal impeller makes it possible to obtain a practically direct draught of the fumes to be expelled from the cooking chamber defined by the muffle. This direct draught, in addition to enabling an improved extraction of the fumes, ensures a constancy of volume of the air drawn in from the cooking chamber, also with a fume outlet of dimensions smaller than the ones that can normally be used in the case of fume-expulsion systems based upon the use of a tangential fan, thus enabling a greater flexibility in sizing during the design stage. The direct draught of the fumes via the radial fan has then the advantage of enabling, when deemed necessary, installation of a filtering element at the fume outlet or at the corresponding flue, which is, instead, currently not recommended in the case of known appliances, precisely considering the fact, referred to above, that—even in the absence of a filter—a tangential fan induces negative pressures that are only modest in a fume outlet of a muffle. Another advantage induced by the proposed solution is represented by the fact that the duct body that defines the intake channel may also be less extensive in length as compared to the bodies that have a similar function in known solutions based upon the use of a tangential fan: the radial fan may in fact be positioned in an intermediate area of the upper wall of the muffle, and not in a position as retracted as possible, as in the case of a tangential fan. This results in a saving of sheet metal and hence in a lower weight and cost of the end product. A further advantage afforded by the proposed solution is that the radial fan does not need a scroll or volute of its own, as instead typically occurs in the case of tangential fans. In the case of the embodiment considered herein it is in fact sufficient to associate to a corresponding opening of the upper wall of the duct body a simple support for the motor of the fan so that only its impeller is located within the boundaries of the delivery channel. Consequently, the savings of material and the number of parts to be assembled is reduced, with further advantages from the production and economic standpoints.

The fact that the rear end region of the duct body has a generally rounded peripheral profile and forms a volute of the radial fan, within which the centrifugal impeller turns, as already mentioned, having to envisage a specific structure that surrounds the centrifugal impeller, which can thus be housed directly in the duct body, in particular in the delivery channel, in the proximity of its region opposite to the corresponding outlet.

Preferentially, the duct body has as a whole a shape generally tapered towards its rear end region (i.e., it is wider in its front part, defined in which is the outlet of the delivery channel and—when envisaged—the inlet of an intake channel) and comprises, once again preferably, a lower half-shell and an upper half-shell.

The radial fan, and in particular its impeller, has an encumbrance in width that may be more contained than that of a normal tangential fan, to the benefit of an overall reduction of the material constituting the duct body. The half-shells may be obtained via simple operations of plastic deformation of sheet metal, even in the absence of particularly deep drawing operations, and then joined together in an equally simple way, for example via peripheral clinching.

The presence of the aforesaid flow-deflector element within the boundaries of the delivery channel bestows greater efficiency on the action of the centrifugal impeller, rendering the delivery flow more homogeneous and preventing any unbalancing thereof.

In a preferred embodiment, the flow-deflector element has two converging side surfaces, which substantially form prolongations of a first stretch and a second stretch of the side of the duct body that are generally concave, where the aforesaid flow-deflector element is set up against the side in question in a generally convex transitional stretch thereof that is located between the first stretch and the second stretch, in a position comprised between the centrifugal impeller and the outlet of the delivery channel. Such a configuration proves extremely advantageous from the fluid-dynamic standpoint, for the reasons set forth above in so far as the deflector element can have contained dimensions and an elementary structure. In an embodiment of this sort, for example, the deflector element may be configured as a simple plastic body with approximately triangular upper and lower faces, which are, on one side, set up against and coupled to the upper wall of the duct body and, on the other side, set up against and coupled to the lower wall of the duct body or else its intermediate wall, when the latter is envisaged.

In a particularly preferred embodiment, the duct body has at least one air intake that is in fluid communication with the delivery channel and that comprises at least one passage at an upper wall of the duct body, and the centrifugal impeller of the radial fan has an upper impeller section and a lower impeller section, which are prearranged for drawing in, respectively, air from the aforesaid at least one passage and fumes from the fume outlet of the muffle, the lower section of the centrifugal impeller being positioned above the fume inlet of the duct body substantially coaxial thereto and to the fume outlet of the muffle.

The presence of an impeller having a lower impeller section enables improvement of the draught of the fumes to be expelled from the cooking chamber. The fact that the duct body has an upper passage and that the centrifugal impeller includes an upper intake section enables a draught of air to be obtained also from the area overlying the duct body in order to enable corresponding cooling thereof: more in particular, this air is drawn in from an upper region of the structure of the appliance in order to induce a flow of cooling air on electrical components that are usually located therein, such as an electronic control card and the motor of the fan. This air that penetrates into the delivery channel can be mixed with the fumes, thereby reducing their concentration and their temperature.

In one embodiment, the radial fan has a structure for its support at an opening of an upper wall of the duct body that is substantially coaxial to the centrifugal impeller, at least one between said opening of the upper wall and said structure defining the aforesaid at least one passage. Very advantageously, hence, the radial fan can be supported by the upper wall of the duct body, at a corresponding upper opening, with the further advantage of reducing the number of components and their corresponding dimensions.

Preferentially, the centrifugal impeller has a set of substantially radial blades with an upper edge and a lower edge, and a number of diaphragm partitions that extend in a transverse direction with respect to an axis of rotation of the impeller in a position intermediate with respect to the upper and lower edges of the blades in order to define the upper and lower sections of the centrifugal impeller.

In an advantageous embodiment, the flue has at least one portion that is made integrally with one between the upper wall of the muffle and the lower wall of the duct body and comprises a drawn part of said wall.

In this way, a further saving of material and a reduction of the number of components to be coupled are enabled, to the advantage of simplicity of assembly and hence of the overall cost of the appliance, in particular if it is considered that the entire flue may possibly be obtained from the aforesaid lower drawn part. The presence of the drawn part in question also functions as spacer element between the upper wall of the muffle and the lower wall of the duct body. Even though the muffle is in general thermally insulated, this enables containment of heat exchange between the parts in question.

In one embodiment, the at least one portion of the flue comprises a drawn part of the lower wall of the duct body that generally projects towards the upper wall of the muffle and that has a lower end portion at which the fume inlet of the duct body is defined. On the other hand, in addition or as an alternative, the at least one portion of the flue may comprise a drawn part of the upper wall of the muffle that generally projects towards the lower wall of the duct body and that has an upper end portion at which the fume outlet of the muffle is defined.

When the flue includes drawn parts of the duct body and of the muffle, the corresponding end portions preferably face one another.

The entire flue can hence be obtained via simple operations of deformation of parts made of sheet metal of the duct body and of the muffle so that there is no longer any need to install a specific tubular element that forms the flue. Drawing of the lower wall of the duct body can in itself be performed in such a way as to form the entire flue, and a similar consideration applies to drawing of the upper part of the wall of the muffle, with all the advantages that derive therefrom, for example in terms of ease and rapidity of assembly of the appliance. This solution imposes, however, the need for operations of deep drawing of the lower wall of the duct body or of the upper wall of the muffle. The fact that the flue is made up of two parts coupled together, each consisting of one piece with a respective wall of the duct body and of the muffle, simplifies formation of the components in question, since it means that the drawing operations to be performed therein do not need to be particularly deep.

In a particularly advantageous embodiment, a filtering element is located substantially at the fume outlet.

The presence of a filtering element proves particularly advantageous in so far as it enables a reduction in the content of contaminating substances drawn into the duct body, and hence also a reduction of the deposits and/or possible expulsion thereof from the front of the appliance. As mentioned previously, even though the presence of such a filter in the known solutions is feasible, it has an adverse effect on the capacity of extraction of the fumes using a fan of a tangential type, this problem being instead effectively solved in the case of the invention thanks to the direct draught of the fumes obtained by the centrifugal impeller. In one embodiment, the filtering element may be operatively set between the lower end portion of the drawn part of the lower wall of the duct body and the upper end portion of the drawn part of the upper wall of the muffle.

In a particularly advantageous embodiment, the drawn part of the upper wall of the muffle and/or the drawn part of the lower wall of the duct body is/are shaped for defining at least part of a housing for the filtering element. In this way, the installation of the filtering element is simplified and precise.

In one such embodiment, a filtering element may be advantageously arranged between the lower end portion of the aforesaid lower drawn part of the duct body and the upper end portion of the upper drawn part of the muffle. Obviously, if the flue consists of just one drawn part of the duct body or else of the muffle, the filtering element can be set between the aforesaid drawn part and the upper wall of the muffle or else the lower wall of the duct body, respectively.

In a particularly advantageous embodiment, the lower end portion of the drawn part of the lower wall of the duct body and the upper end of the drawn part of the upper wall of the muffle are both shaped for defining a respective part of a housing of the filtering element. In this way, installation of the filtering element does not require corresponding additional positioning elements. In this perspective, advantageously, each of the aforementioned two end portions defines a corresponding part of a housing for the filtering element. Also in this case, if the flue consists of just one drawn part of the duct body or else of the muffle, the solution of providing at least part of the housing for the filtering element in the aforesaid single drawn part can be equally applied to advantage.

In one embodiment, the duct body has an upper wall and at least one intermediate wall between its lower and upper walls and is set generally facing them in order to define in the duct body both the delivery channel and an intake channel that extends underneath the delivery channel. In such a case, the at least one air intake comprises an inlet of the intake channel which is substantially at the aforesaid upper portion of the door, underneath the outlet of the delivery channel, and the intermediate wall has an opening substantially coaxial with respect to the centrifugal impeller in such a way that the radial fan draws into the delivery channel both the fumes from the fume outlet of the muffle and air from the inlet of the intake channel in order to force a resulting mixed fume/air flow into the delivery channel towards the corresponding outlet.

With this solution, the fumes extracted from the cooking chamber can be further mixed with air taken in at the front of the appliance, thereby reducing the concentration of the fumes that are forced by the impeller into the delivery channel and lowering their temperature.

In one embodiment, in particular when the aforesaid intake channel is envisaged, it is advantageous for the door of the appliance to comprise at least an outer door panel, an inner door panel, and an intermediate door panel, the door panels defining between them a plurality of gaps, amongst which at least an external gap and an internal gap, each having a lower inlet and an upper outlet, at a lower portion and an upper portion of the door, respectively, for passage of a respective flow of cooling air.

In this way, the air that is drawn in from the outside via the intake channel may be air taken in from one or more of the aforesaid gaps, thereby bringing about a continuous flow of air into the gaps, from their lower openings to their upper openings, which enables an effect of cooling of the door to be obtained. It should be noted that such a solution can be applied also to the case of doors with a single external panel and a single internal panel, and hence with just one cooling gap, or also to the case of doors with more than one intermediate panel, and hence with two or more cooling gaps intermediate between the external one and the internal one.

In such an embodiment, the door defines one or more cooling gaps, at the upper portion of the door there may be provided deflector means, configured for shielding the inlet of the intake channel from the outlet of the delivery channel. The deflector means advantageously fulfills the function of preventing any disturbance between the flow at inlet to the intake channel and the flow at outlet from the delivery channel. If the door defines one or more cooling gaps, the deflector means may be configured so that the air drawn in by the radial fan from the inlet of the intake channel comprises air exiting from the upper outlet of at least one gap of the door: in this way, in the at least one gap there is induced a flow of cooling air; as an alternative or in combination, the deflector means may be configured for causing the mixed fume/air flow expelled from the outlet of the delivery channel to induce a draught effect with respect to at least one gap of the door, i.e., to cause a difference of pressure between its lower inlet and its upper outlet that causes in the gap itself a flow of cooling air.

In a particularly advantageous embodiment, in which the door includes a plurality of cooling gaps, the aforesaid deflector means are configured for shielding the outlet of at least one first gap closer to the cooking chamber, in particular the internal gap, from the outlet of at least one second gap more spaced apart from the cooking chamber, in particular the external gap. In this way, the functions just described above add up, with the air drawn into the intake channel that is air from the gap closer to the cooking chamber and with the mixture expelled from the delivery channel that induces the draught effect in the gap further away from the cooking chamber.

The intermediate wall of the duct body preferably has a profile, in top plan view, substantially corresponding to the profile, in top plan view, of the upper half-shell and of the lower half-shell. In this way, when the intake channel and the delivery channel are envisaged, the duct body can be obtained in a simple and fast way, setting the intermediate wall between the two half-shells before the latter are rendered fixed with respect to one another. In this perspective, the peripheral clinching referred to above can be obtained so that between the clinched edges of the two half-shells is a peripheral edge for fixing the intermediate wall.

BRIEF DESCRIPTION

Further aims, characteristics, and advantages of the present invention will emerge clearly from the ensuing detailed description, with reference to the annexed schematic drawings, in which:

FIG. 4 is a schematic perspective view of a muffle of the appliance of FIG. 1, with a corresponding duct body associated to its upper wall;

FIG. 5 is a schematic perspective view of the muffle of FIG. 4;

DETAILED DESCRIPTION OF THE PREFERRED EMBODIMENTS

Figure 2:
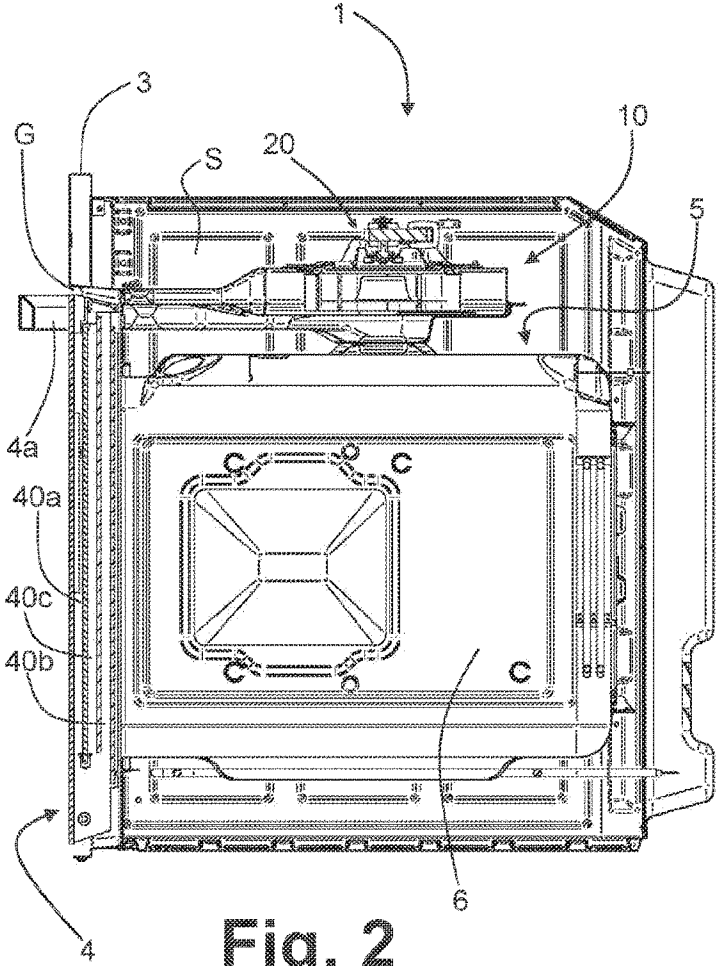
FIG. 2 is a schematic cross section according to the axis II-II of FIG. 1.
Figure 1:
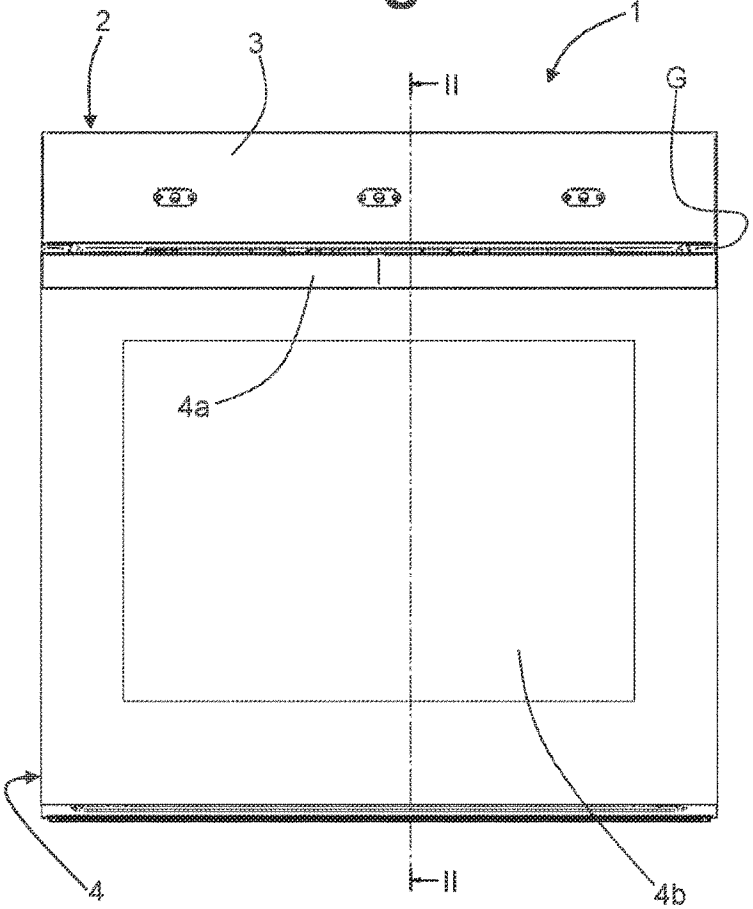
FIG. 1 is a schematic view in front elevation of a cooking appliance according to the present invention.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment," and the like, that may be present in different points of this description do not necessarily refer to the same embodiment of the oven forming the subject of the present invention. Furthermore, particular conformations, structures, or characteristics may be combined in any adequate way in one or more embodiments, even different from the ones represented. The references used herein are provided merely for convenience and hence do not define the sphere of protection or the scope of the embodiments. Furthermore, the cooking appliance will be described in what follows limitedly to the elements necessary for an understanding of the invention, taking for granted that it includes all the other components normally known and necessary for its operation.

With initial reference to FIGS. 1-5, designated as a whole by 1 is a household cooking appliance according to the invention, here represented by a built-in oven. The invention may in any case be applied also to free-standing ovens and to kitchen ranges integrating an oven. The oven 1 has a load-bearing structure or body, designated by 2, associated to the front of which in a stationary way is a control panel 3, comprising control means and/or display means for control of the functions of the oven, these means not being represented herein. Associated to the front part of the body 2 is a front door 4, in particular hinged in a lower region thereof, provided with a handle 4*a*. In a preferred embodiment, the structure of the door 4, which is preferably made at least in part of metal, comprises a plurality of door panels 4*b*, 4*c*, 4*d*, and 4*e*, which define between them a series of cooling chambers, as described hereinafter. The lower edge of the control panel 3 and the upper end of the door 4 are separated from one another by a space or gap, designated by G: the presence of this gap prevents the panel 3 from constituting a hindrance to opening of the door itself and—as will emerge hereinafter—enables passage of at least one forced flow of air from a fan.

Housed within the body 2 is a muffle, designated as a whole by 5. The muffle 5 has a rigid metal body, for example obtained using sheet metal, having an upper wall, a lower wall, a rear wall, and two side walls (only one of which is visible), designated by 5*a*, 5*b*, 5*c*, and 5*d*, respectively. The muffle 5 is preferentially thermally insulated via an insulation jacket, of a conception in itself known (not represented). The body of the muffle 5 defines a cavity or cooking chamber 6, which can be opened and closed at the front by means of the door 4. For this purpose, associated to the muffle 5 are means for heating the cooking chamber (here not represented). For this purpose, electrical resistances may, for example, be provided, two of which are partially visible, one underneath the lower wall of the muffle and the other associated to its rear wall.

Designated as a whole by 10 is a duct body, with a ventilation assembly 20 associated thereto, forming part of a system for extraction of fumes from the cooking chamber 6. As will emerge from what follows, the duct body 10 defines a delivery channel, at least one air intake in fluid communication with the aforesaid delivery channel, and possibly an intake channel.

With reference in particular to FIG. 4, visible therein is the body of the muffle 5, which may be made of a single piece of sheet metal or of a number of parts of sheet metal fixed together. Associated to the upper wall 5*a* of the muffle 5 is the duct body 10, which extends over said wall approximately parallel thereto so that its front part, which here has a width comparable to the width of the muffle 5, is substantially located at the front of the appliance, in the vicinity of the gap G and of the upper portion of the door 4 (see, for example, FIGS. 2 and 3). In FIG. 4, the ventilation assembly 20 is not represented, but an opening of the upper wall of the body 10 is visible, present in the rear region of the latter, where the ventilation assembly is to be mounted.

Visible in FIG. 5 is just the body of the muffle 5, defined in the upper wall of which is a fume outlet 7. The fume outlet 7 comprises a through hole or opening of the upper wall 5*a*, which is preferentially defined in a central area of the wall itself. In an advantageous embodiment, such as the one exemplified, the fume outlet 7 is located in an area corresponding to a drawn part 8 of the wall 5*a*, which generally projects upwards. As will emerge from what follows, this upper drawn part 8 of the muffle provides at least a portion of a flue for extraction of fumes from the cooking chamber 6. In a particularly advantageous embodiment, the drawn part 8 is shaped so as to define a housing 8*a*, in which a filtering element can be positioned at least in part, as described hereinafter.

Figures 6, 7, 8:
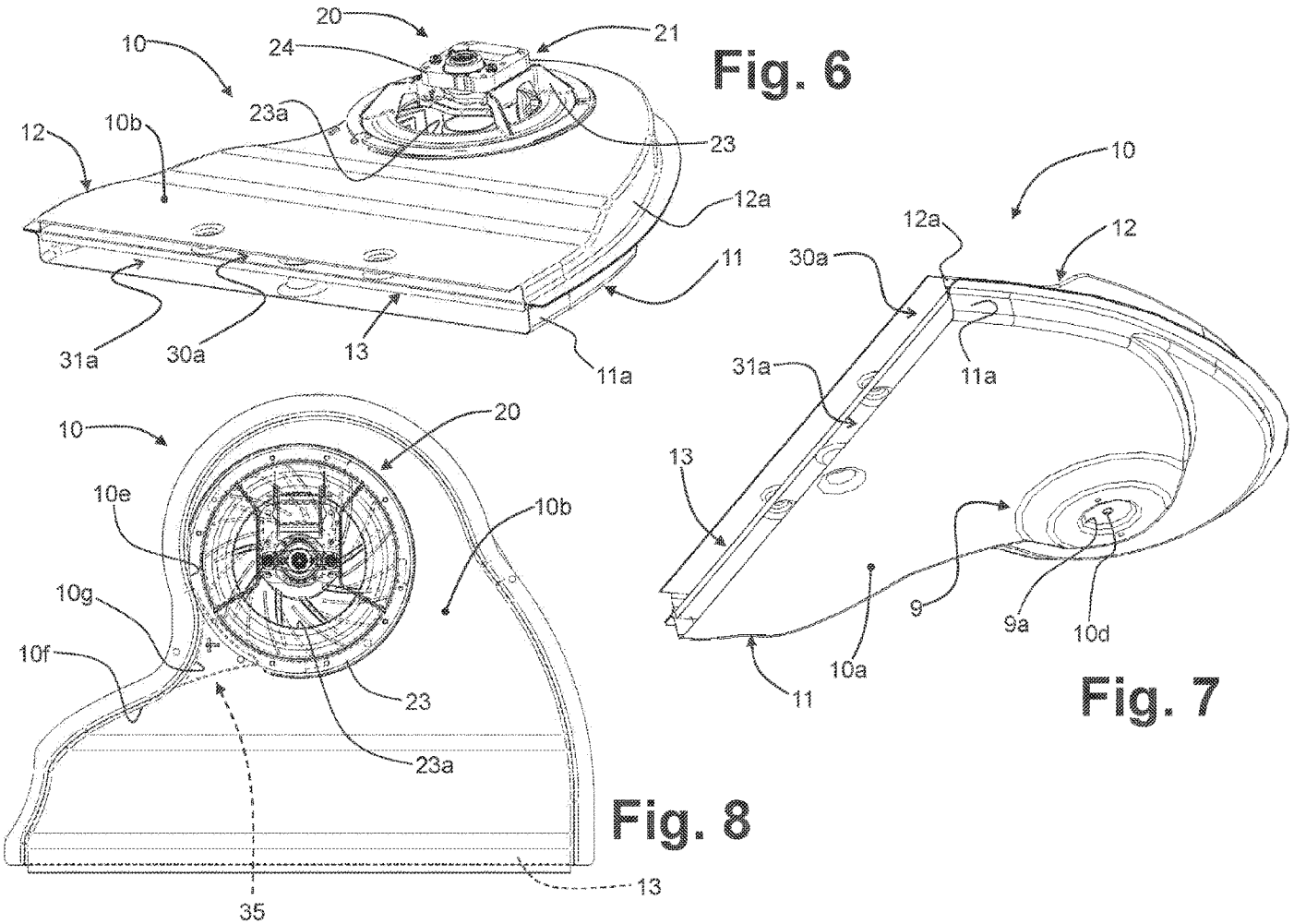
FIGS. 6 and 7 are views from different angles of a duct body with a corresponding ventilation assembly associated thereto.
FIG. 8 is a schematic top plan view of the duct body of FIGS. 6 and 7.

The duct body 10, with the ventilation assembly 20 associated thereto, is visible in different views in FIGS. 6-8. From these figures, there may be appreciated the generally tapered shape of the body 10, starting from its front part towards its rear end region, where the ventilation assembly 20 is mounted.

In a preferred embodiment, the body 10 is made up of a number of parts, comprising a lower half-shell 11, which defines the lower wall 10*a* of the body 10, and an upper half-shell 12, which defines the upper wall 10*b* of the body 10. In the embodiment currently considered, the body 10 defines both an intake channel and a delivery channel so that the body itself preferably comprises an intermediate wall 13, having a tapered profile in top plan view that substantially corresponds to the profile in top plan view of the half-shells 11 and 12. The various parts in question of the body 10, as well as the ventilation assembly 20, are clearly visible in the exploded views of FIGS. 9 and 10.

As may be seen, the half-shells 11 and 12 preferentially define, in addition to the lower wall 10*a* and the upper wall 10*b*, also respective portions of the sides of the body 10, said portions of the sides being designated herein by 11*a* and 12*a*, respectively. The half-shells 11, 12 and the intermediate wall 13 may be obtained from sheet metal, via simple operations of shearing and stamping and/or drawing, with modalities in themselves known. As may be noted, preferentially, the half-shells have respective peripheral edges, not represented here, which project substantially orthogonally from the side portions 11*a* and 12*a* and are used for coupling the half-shells themselves to one another, with a technique in itself known, for example clinching, welding, or riveting. Advantageously, when also the intermediate wall 13 is provided, the latter has a respective peripheral edge (not shown), which is set between the peripheral edges of the half-shells 11 and 12 for the purposes of the aforesaid coupling. Regardless of the specific mode of coupling, in the assembled configuration, the opposite major faces of the wall 13 generally face the lower wall 10*a* and the upper wall 10*b* so that in the body 10 both a delivery channel and an intake channel, described hereinafter, will be defined.

Figure 10:
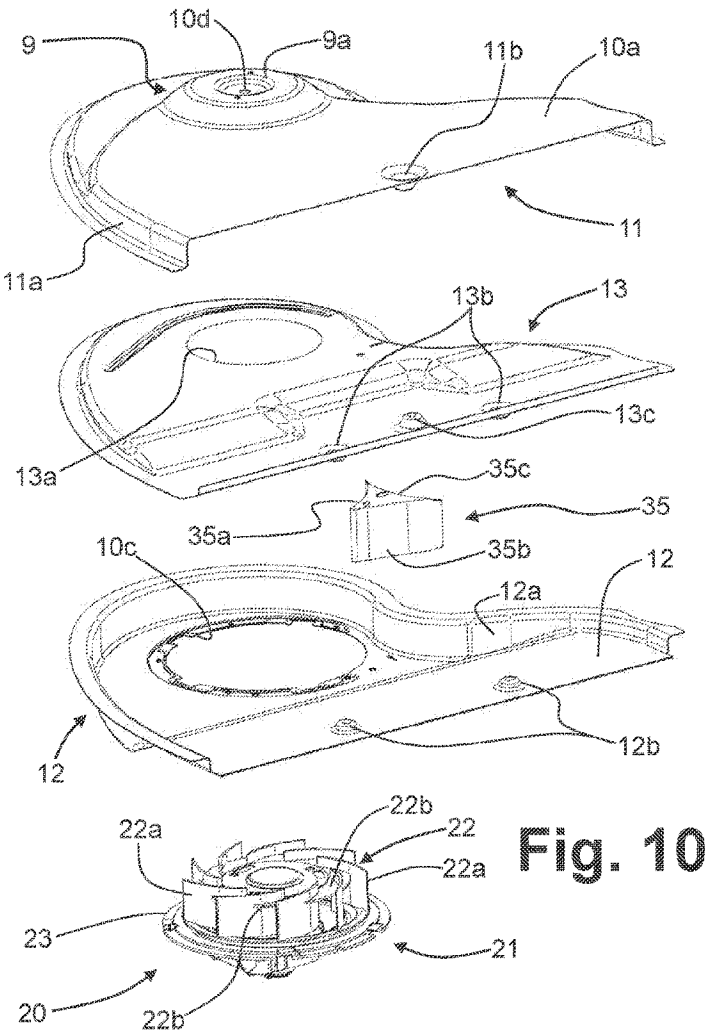
FIGS. 9 and 10 are exploded views, from different angles, of the duct body of FIGS. 6-7.
Figure 9:
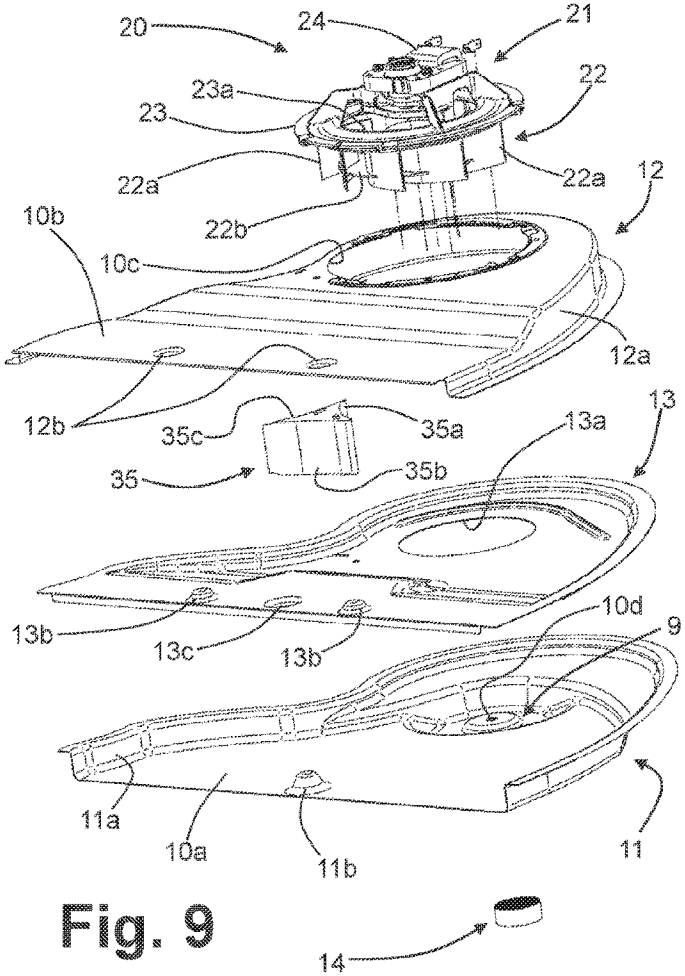

From FIGS. 9 and 10 it may be noted how, in the rear region of the body 10, and specifically in its upper wall 10*b* an opening 10*c*, which is preferably substantially circular, is defined, where the ventilation assembly 20 is to be mounted. From the aforesaid figures, as well as from FIG. 7 it may be noted how defined in the lower wall 10*a* of the body 10 is a fume inlet 10*d*. The fume inlet 10*d* of the body 10 comprises a through hole or opening in its wall 10*a*, which preferentially—but not necessarily—has a section of passage or diameter smaller than that of the fume outlet 7 of the muffle 5.

In an advantageous embodiment, such as the one exemplified, the fume inlet 10*d* is located at a drawn part 9 of the wall 10*a*, which—in the mounted condition of the body 10—generally projects downwards, i.e., towards the upper wall of the muffle 5. As will emerge from what follows, this lower drawn part 9 of the body 10 provides at least one portion of a flue for extraction of fumes from the cooking chamber 9. In a particularly advantageous embodiment, the drawn part 9 is shaped so as to define a housing 9*a*, in which a filtering element, designated as a whole by 14 in FIG. 9, may be positioned at least in part.

The intermediate wall 13 has in its rear region a respective through opening 13*a*, which is preferably but not necessarily circular. Once again preferentially, the diameter of the opening 13*a* is larger than that of the opening 10*d* of the body 10. In the assembled condition of the body 10, the opening 10*c* of the upper wall 10*b* is at least approximately coaxial or in any case aligned to the fume inlet 10*d* of the lower wall 10*a*, and, when the intermediate wall 13 is provided, also the corresponding opening 13*a* is at least approximately coaxial or in any case aligned to the fume inlet 10*d*, and hence also to the opening 10*c*.

Once again from FIGS. 9-10 it may be noted how, at the front end of the walls 10*a* and 10*b* defined by the half-shells 11 and 12, as well as of the intermediate wall 13, positioning bosses are provided that co-operate with one another, which also perform functions of spacers. In the example of embodiment, the upper half-shell 12 has two bosses 12*b* that project downwards, whereas the lower half-shell 11 has a boss 11*b* that project upwards, in a position generally intermediate with respect to the bosses 12*b*; on the other side, the intermediate wall 13 has two lateral bosses 13*b* that project upwards, designed to co-operate with the two bosses 12*a* of the upper half-shell 12, as well as a central boss 13*c* that projects downwards, designed to co-operate with the boss 11*b* of the lower half-shell 11. As has been said, these bosses basically have the function of ensuring positioning and the distances between the front parts of the half-shells 11, 12 and of the wall 13 in order to define precisely the outlet and the inlet, respectively, of the delivery and intake channels referred to previously. The aforesaid outlet and inlet are visible, for example, in FIGS. 6 and 7, where they are designated by 30*a* and 31*a*, respectively.

The ventilation assembly 20 forming part of the system for extraction of the fumes from the cooking chamber 6 comprises a radial fan having a centrifugal impeller, designated, respectively, by 21 and 22 in FIGS. 9 and 10. In the preferred embodiment exemplified, the assembly 20 also includes a structure or support 23 for the fan 21. The support 23, preferably made of metal, here has a generally annular configuration so that it can be coupled and fixed to the upper wall 10*b* of the body 10, at the opening 10*c*. Preferentially, the diameter of the opening 10*c* is larger than the diameter of the impeller 22 in order to enable easy insertion of the latter within the body 10, in the production stage. In the example illustrated, the support 23 has an annular peripheral part, which rests and is substantially fixed along the edge of the opening 10*c*, and a series of substantially radial uprights for supporting the motor 24 of the fan 21 on the outside of the body 10. The annular part of the support 23 is fixed, at the opening 10*c* of the body 10, preferably via threaded members or rivets, possibly with the aid of brackets. The motor 24 has a single shaft that identifies the axis of rotation of the impeller 22. This shaft (not shown), projects downwards from the body of the motor 24 for rotatably supporting the impeller 22 within the body 10.

As already mentioned, the body 10 has at least one air intake, which in the example illustrated comprises at least one passage at the upper wall 10*b* of the body itself. In the example, the support 23 has a structure that is in part annular and in part spoked so as to define a series of passages, designated by 23*a* in FIGS. 6, 8 and 9, which, together with the opening 10*c* of the upper wall 10*b*, form an upper air intake.

The centrifugal impeller 22 has an upper impeller section and a lower impeller section, prearranged for drawing in air from the aforesaid passage and for drawing in fumes from the fume outlet 7. In one embodiment, such as the one illustrated in FIGS. 9-10, the impeller 22 has a set of substantially radial blades 22*a* and a set of partitions 22*b* that extend in a transverse direction with respect to the axis of rotation of the impeller itself, in an intermediate position between the upper and lower edges of the blades 22*a*. The partitions 22*b*, which may also be replaced by a single partition transverse to the blades 22*a*, hence define in the impeller 22 an upper section and a lower section. The division of the impeller into two different generally coaxial intake sections can also be obtained with a different configuration, for example by providing two distinct sets of appropriately shaped and oriented blades.

Regardless of the specific embodiment, the upper section of the impeller 22 is provided for drawing in air from the outside of the body 10 through the passages 23*a*, i.e., from an internal area of the structure of the appliance that extends over the muffle 5. Installed in one such area, designated by S in some figures, are electrical/electronic components of the appliance, which typically include an electronic control card of the appliance. Provided in the structure 2 are inlet openings for air coming from outside (not visible) in such a way that the upper section of the impeller 22 induces within the area S a flow of air—from the aforesaid openings to the passages 23*a*—that laps the aforesaid electrical/electronic components in order to cool them. The aforesaid inlet openings may for example be defined in the panel 3 and/or in a wall (not represented) that closes the space S at the top and/or in the sides and/or the back of the structure 2, or once again in areas of joining between the aforesaid parts. This air that penetrates into the body 10 through the passages 23*a* can mix with the fumes, thereby reducing their concentration and their temperature.

Figure 11:
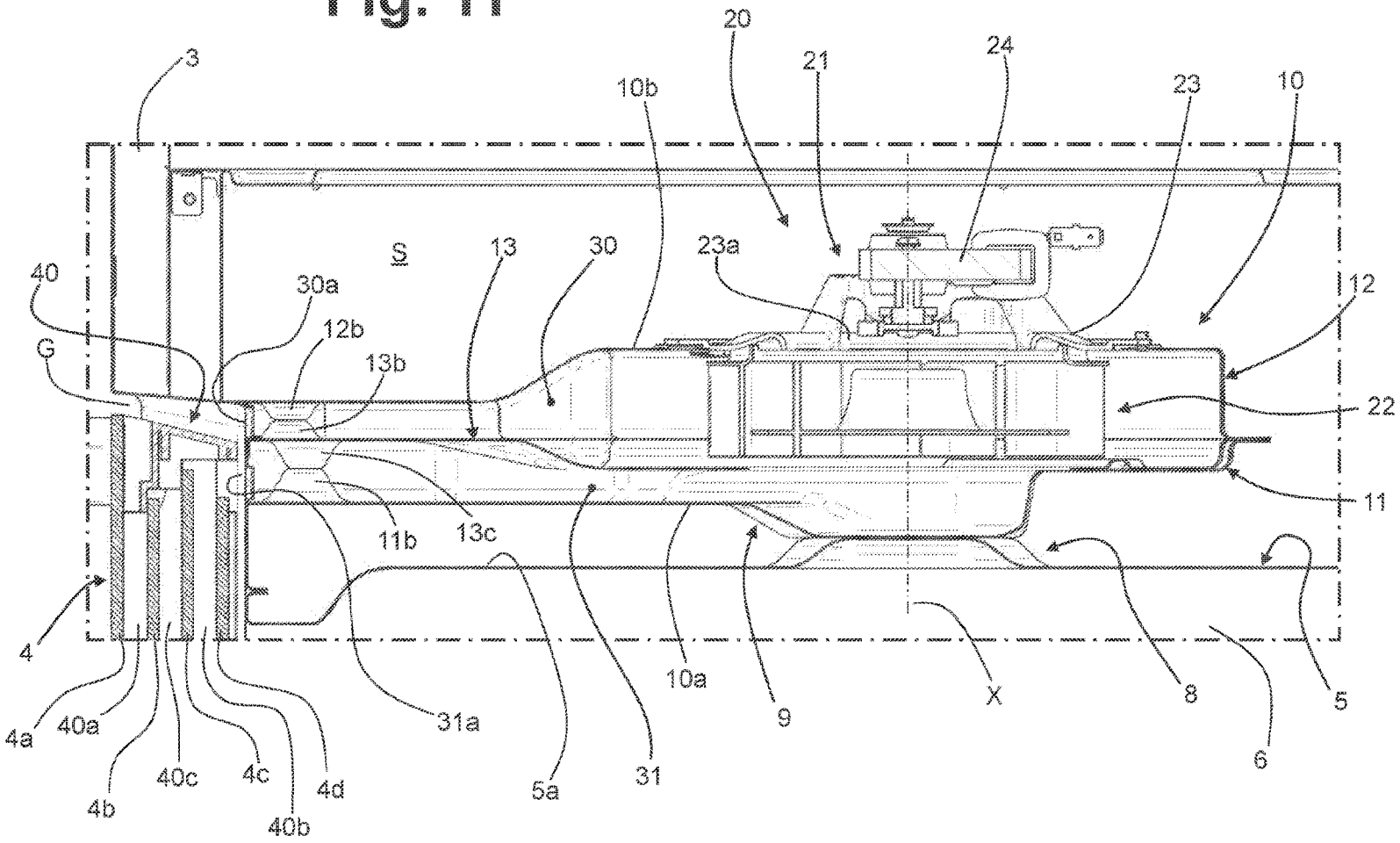
FIG. 11 is a detail at a larger scale of FIG. 2.
Figure 12:
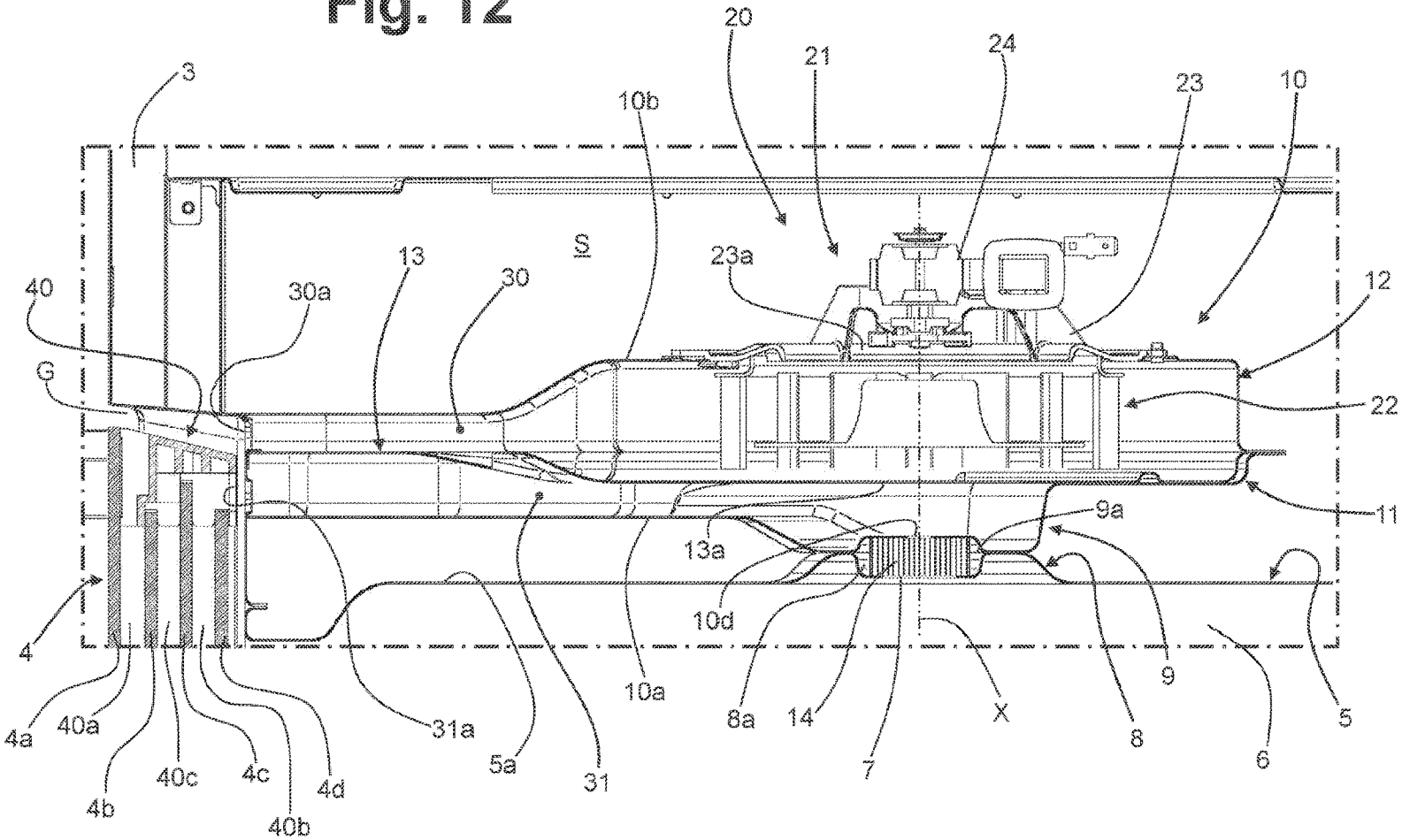
FIG. 12 is a schematic cross section similar to that of FIG. 11, with a different plane of section.

The condition of the body 10, along with the ventilation assembly 20, assembled on the muffle 5 is visible in the cross-sectional views of FIGS. 11 and 12. It is to be noted that these cross sections have a merely explanatory and schematic nature, having been created artificially for highlighting parts of interest. In these figures, it may clearly be noted how the duct body 10 is mounted so as to extend above the upper wall 5*a* of the muffle 5. Defined within the body 10, via the intermediate wall 13, are the delivery and intake channels already referred to, designated by 30 and 31, with the respective outlet 30*a* and inlet 31*a* substantially at the front of the appliance, where the intake channel 31 extends underneath the delivery channel 30. From these figures, and in particular from FIG. 12 it may clearly be noted how the centrifugal impeller 22, and in particular its lower section, is positioned above the fume inlet 10*d* of the body 10, at a distance therefrom and substantially coaxial thereto and to the fume outlet 7 of the muffle 5. As may be noted, in the example represented, the axis of rotation X of the impeller 22 substantially coincides with the axes of the aforesaid fume inlet 10*d* and fume outlet 7. The fume outlet 7 is in fluid communication with the fume inlet 10*d* and with the delivery channel 30, through the opening 13*a* of the intermediate wall 13, which is substantially at the centrifugal impeller 22 and preferably completely underneath its lower section.

In this way, the fumes are drawn in from the lower section of the impeller 22 through the corresponding outlet 7 substantially in the direction of the axis X of the impeller itself in order to be forced by the latter in a radial direction, into the delivery channel 30, for then being expelled from the corresponding outlet 30*a*. It will be appreciated that the fumes are drawn in from the lower section of the impeller 22, together with air taken in from outside through the intake channel 31, the inlet 31*a* of which provides an air intake from the outside of the structure 2. In this way, forced into the delivery channel 30 is a mixed fume/air flow, also including the air drawn in through the passages 23*a*. As explained previously, the use of the radial fan 22 enables important advantages to be achieved, as a result of the effect of direct draught that makes possible, among other things, a fume-outlet passage also of restricted dimensions and possibly with a filtering element associated thereto. By way of indication, the fume-outlet passage (hole 10*d* and/or hole 7) may have a maximum diameter even smaller than 10 mm, for example 8 mm, decidedly smaller than the diameters of traditional ovens with a tangential fan provided with pyrolytic function and associated filter (approximately 35 mm) or not provided with pyrolytic function (approximately 20 mm).

As has been said, the fan is mounted in the rear region of the body 10, which is shaped so as to form the volute for the impeller 22. For this purpose, as highlighted in FIGS. 6-10, the aforesaid rear end region of the body 10 has a generally arched peripheral profile.

Once again from FIGS. 11 and 12 it may clearly be noted how the upper drawn part 8 of the muffle 5 and the lower drawn part 9 of the body 10 provide respective parts of a flue, with the fume outlet 7 defined in an upper end portion of the drawn part 8 and the fume inlet defined in a lower end portion of the drawn part 8, said end portions facing one another. In this way, at least a substantial portion of the flue can be defined integrally by a component that must be in any case mounted on the muffle, i.e., the duct body 10. Very advantageously, this makes it possible to also produce the remaining part of the flue integrally with another component that is in any case necessary, i.e., the muffle 5. The proposed solution hence avoids the need to produce and install a distinct tubular element that provides the flue, as typically occurs in known solutions. As previously shown, the entire flue could possibly be obtained via a deeper drawing of the lower wall 10*a* of the duct body 10 or else of the upper wall 5*a* of the muffle 5.

In one embodiment, such as the one exemplified, the aforesaid end portions have respective substantially plane parts that bear upon one another and that have respective holes—not indicated but visible, for example, in FIGS. 5 and 7—for elements for mutual fixing, such as for example screws or similar threaded members.

FIG. 12 clearly highlights how between the upper end portion of the drawn part 8 and the lower end portion of the drawn part 9 there may be operatively arranged a filtering element 14, designed to contain emission of undesirable substances from the cooking chamber. The filtering element 14 may advantageously be a catalytic ceramic filter of a conception in itself known, suitable for catalysing nitrogen oxides (NOx) when a temperature of the fumes of approximately 370° C. is exceeded, which is in any case a temperature lower than the one that the fumes at outlet from the muffle 5 typically have during pyrolytic cleaning functions.

As mentioned previously, at least one of the two drawn parts 8 and 9, and preferably both, define respective portions 8*a* and 9*a* of a housing for the filtering element 14, without the need for specific additional components. In the example, the filtering element is substantially cylindrical, and the corresponding portions 8*a* and 9*a* of its housing are hence basically cylindrical. These portions 8*a* and 9*a* of the housing for the filtering element 14 are substantially in the form of recesses defined in the end portions of the drawn parts 8 and 9, respectively.

Once again in FIGS. 11 and 12, it may clearly be noted how the motor 24 of the fan 21 is carried by the support 23 substantially on the outside of the body 20, with its centrifugal impeller 22 completely housed in the delivery channel 30. The flow of air induced from the upper section of the impeller 22 into the passages 23*a* enables also cooling of the motor 24 to be obtained.

In a preferred embodiment, such as the one exemplified, provided inside the duct body 10 is a flow-deflector element, configured for rendering the forced flow of the centrifugal impeller 22 along the delivery channel 30 uniform. A deflector element of this sort is designated as a whole by 35 in FIGS. 8-10. The deflector element 35 has two converging side surfaces, designated by 35*a* and 35*b* in FIGS. 9 and 10, which substantially form a prolongation of a first generally concave stretch and a second generally concave stretch of the side of the duct body 10, respectively. The aforesaid lateral stretches are designated by 10*e* and 10*f* in FIG. 8, in which it may likewise be noted how another face 35*c* of the deflector element 35 is set up against the side in question in a generally convex transitional stretch thereof 10*g*, which is located between the stretches 10*e* and 10*f*. From the same figure, it may be noted how the element 35 is positioned in an area generally comprised between the centrifugal impeller 22 and the front of the body 10, where the outlet of the delivery channel is located. As has already been pointed out, the presence of the deflector element 35 proves advantageous from the fluid-dynamic standpoint in order to render the flow pushed by the impeller along the delivery duct more homogeneous. The element 35 is here constituted by a body having a simple structure, for example made of plastic material, the upper and lower faces of which are approximately triangular and designed to be, on one side, set up against and coupled to the upper wall 10*b* of the body 10 and, on the other side, set up against and coupled to the upper face of the intermediate wall 13. When the wall 13 is not present, as in an embodiment described hereinafter, the lower face of the element 35 is set up against and coupled to the lower wall 10*a* of the body 10. The height of the element 15, i.e., the distance between its upper and lower faces, hence substantially corresponds to that of a corresponding portion of the delivery channel 30, i.e., slightly greater than the height of the blades 22*a* of the impeller 22. Preferentially, provided in one or both of the aforesaid upper and lower faces of the deflector element 35 are projecting engagement elements (not indicated but visible in FIGS. 9-10), which are designed to couple in a unique way in respective seats present in the upper wall and in the intermediate wall (or else in the lower wall) of the body 10 in order to ensure a fixed and unique positioning of the deflector element itself, without any possibility of error in the assembly step.

In the embodiment exemplified in the figures—observing the duct body from above, such as for example in the view of FIG. 8—the impeller 22 is operated in rotation in a clockwise direction, given that the deflector element 35 is set on the left-hand side of the body. It will be appreciated that, in the case of use of a fan with impeller turning in a counterclockwise direction, the deflector element 35 may be positioned on the opposite side, with the corresponding rear portion of the duct body that defines the volute of the fan modified accordingly (i.e., substantially with a shape specular to the one represented in FIG. 8).

As mentioned in the introductory part of the present description, in the appliance 1 the fume-extraction system, including the duct body 10 and the fan 21, can be used for contributing to cooling of the door 4.

Figure 3:
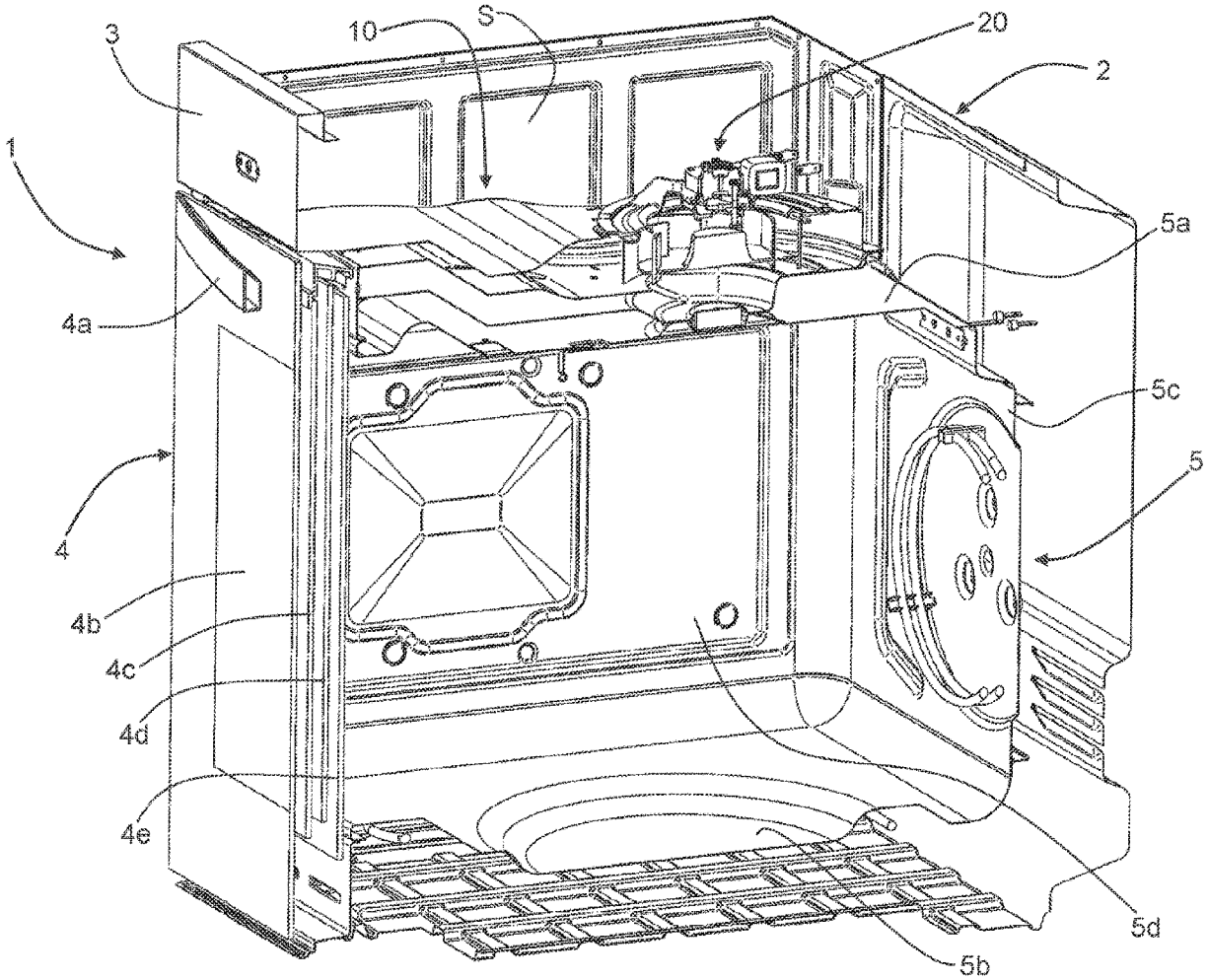
FIG. 3 is a sectioned perspective view of the appliance of FIG. 1.
Figure 13:
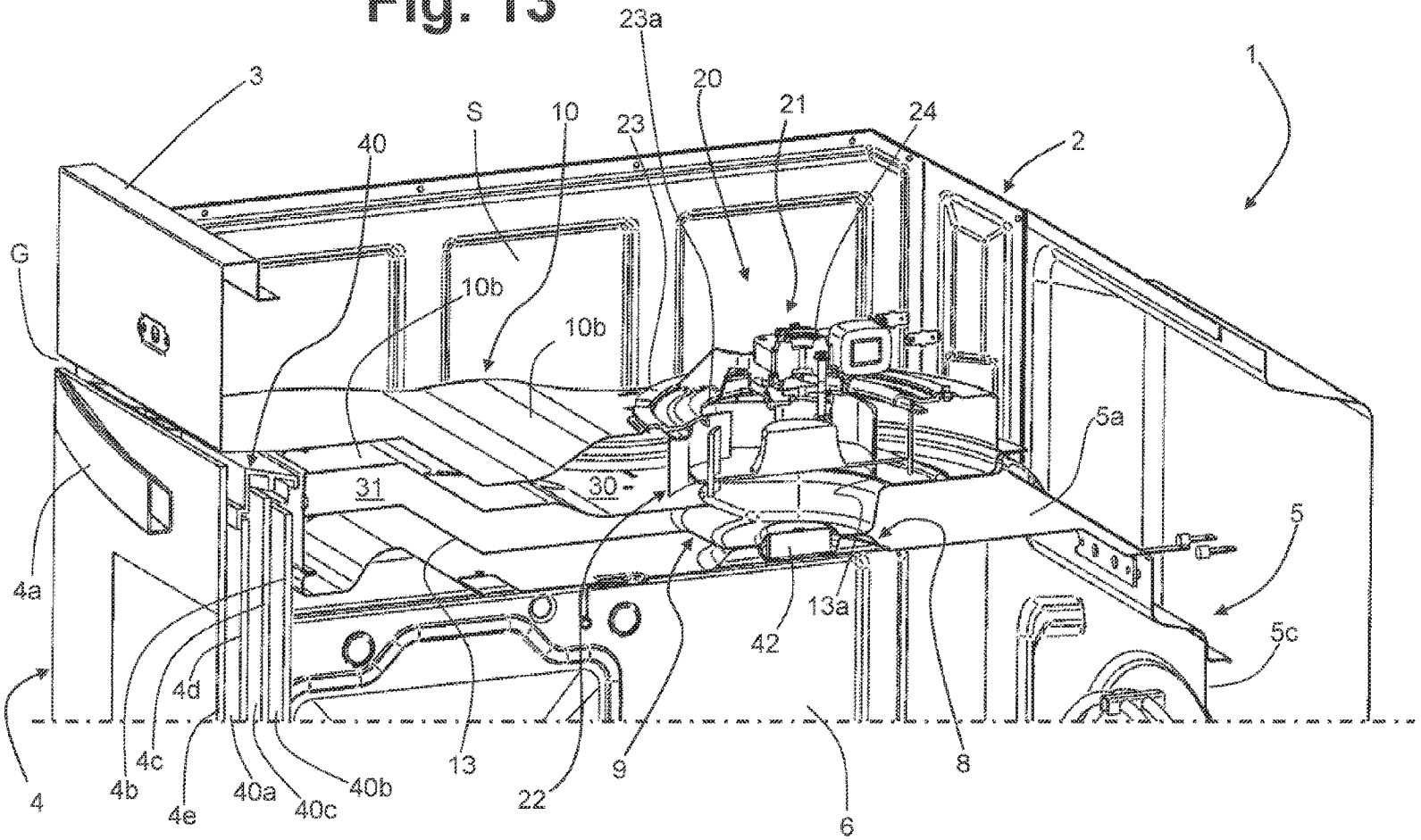
FIG. 13 is a detail at a larger scale of the appliance of FIG. 3.

As already pointed out with reference to FIG. 3, and as may be seen also in FIGS. 11, 12 and 13, the door 4 comprises a series of panels, preferably but not necessarily panels made of transparent glass or similar material, between which respective gaps are defined. In the embodiment exemplified in the figures an external panel 4*b*, an internal panel 4*e*, and two intermediate panels 4*c* and 4*d* are provided, which define between them three gaps, of which an external one, i.e., set further away from the cooking chamber 6, an internal one, i.e., set closer to the cooking chamber 6, and one set in an intermediate position. In FIGS. 11-13, the external gap is designated by 40*a*, the internal gap is designated by 40*b*, and the intermediate gap is designated by 40*c*. In other embodiments, the door 4 may comprise just three panels, and hence only the external gap and the internal gap, or possibly just two panels that define between them just one gap. As may be appreciated from FIG. 2 (where only the gaps are indicated) and from FIG. 3 (where only the panels are indicated), the various gaps provided have a lower inlet and an upper outlet, substantially at the lower portion and at the upper portion of the door, respectively.

With reference in particular to FIGS. 11-13, it may be noted how the inlet 31*a* of the intake channel is substantially located at the upper portion of the door 4 in a position generally facing the upper portion and close to the upper outlets of the gaps 40*b*-40*c*. The outlet 30*a* of the delivery channel 30 is instead set at a height greater than the inlet 31*a*, in a position generally facing the space or gap G in order to be able to expel the fume/air mixture directly into the external environment.

At the upper portion of the door are deflector means, designated as a whole by 40. In the example, these means are constituted by a profile belonging to the structure of the door, mounted at the upper ends of at least some of the door panels (here the panels 4*c*-4*e*). The aforesaid profile 40 has a base, here generally inclined downwards towards the cooking chamber, which overlies the upper outlets at a certain distance therefrom, as well as a series of lower projections for positioning with respect to the panels and the gaps 40*b* and 40*c*. The configuration of the profile 40 is such that at least the upper part thereof shields the inlet 31*a* of the intake channel 31 with respect to the outlet 30*a* of the delivery channel 30, with at least the upper outlet of the internal gap 40*b* and the upper outlet of the intermediate gap 40*c* (if the latter is envisaged), which are in any case set in fluid communication with the inlet 31*a* of the intake channel 31. In this way, as may be appreciated, the air drawn in by the radial fan 21 from the inlet 31*a* comprises air exiting from the upper outlet of the internal gap 40*b* and, in the case exemplified, also from the upper outlet of the intermediate gap 40*c*. In this way, the action of suction of the fan 21 along the intake channel 31 induces a flow of relatively fresh air, taken in from the inlets of the gaps 40*b*, 40*c* that are located at the lower part of the door. The aforesaid air flows upwards along the gaps 40*b*, 40*c*, thereby cooling the door 4, in its part generally facing the cooking chamber 6. This air then passes into the intake channel 31, for mixing with the fumes drawn in from the flue 8-9. The fumes are then diluted with relatively pure air, and then pass into the delivery channel 30. It will be appreciated that in this way there is also obtained a corresponding abatement of the temperature of the fumes that traverse the impeller 22 and a dilution thereof in air, such as to limit deposit of fats.

With reference to the embodiment exemplified, the deflector means, here represented by the profile 40, are also configured for shielding the upper outlet of the external gap 40*a* with respect to the upper outlet of the internal gap 40*b* and of the intermediate gap, when this is envisaged. In the case exemplified, this function is basically obtained by the base part of the profile 40, the inclined upper surface of which is here used for delimiting a bottom of the gap G in an area corresponding to the gaps 40*b* and 40*c*. Instead, the upper opening of the external gap 40*a* opens substantially at the upper end of the door 4, and hence of the gap G. In this way, the mixed fume/air flow that is forced by the radial fan 21 out of the outlet 30*a* of the delivery channel 30 induces a draught effect with respect to the external gap 40*a*; i.e., it induces a difference of pressure between its lower inlet and its upper outlet. Also in this case, then, in the external gap 40*a* a flow of relatively fresh cooling air is induced, which traverses the gap from its lower inlet to its upper outlet. This flow of air, which enables cooling of the outer side of the door 4, mixes with the flow at outlet from the delivery channel 30, thereby also contributing to reducing the temperature of the latter.

It will be appreciated that, in a different embodiment, the draught effect that can be obtained via the flow at outlet from the channel 30 could be exploited for inducing a flow of air also in the intermediate gap 40*c*, in which case the profile 40 will be modified accordingly. As explained previously, the concepts set forth can be applied also to the case of a door with just two gaps, and possibly also in the case of a door with just one gap. In this latter case, the flow of cooling air in the single gap can be induced via the flow at outlet from the channel 30 or via the flow at inlet to the channel 31, when this is present.

The presence of the intake channel 31, in fact, albeit preferable, is not indispensable for the purposes of implementation of the invention. The channel 31 may also be present in embodiments in which the door of the appliance 1 does not have gaps traversed by corresponding cooling flows, in particular when it is desired in any case to obtain a mixing of the fumes with air drawn in from the outside of the appliance, prior to the corresponding expulsion into the environment. Instead, the channel 31 may be absent in the aforesaid case of doors without gaps traversed by cooling flows, or when in any case the duct body principally performs functions of extraction of the fumes without them being mixed with air taken in from the outside of the appliance.

Figure 15:
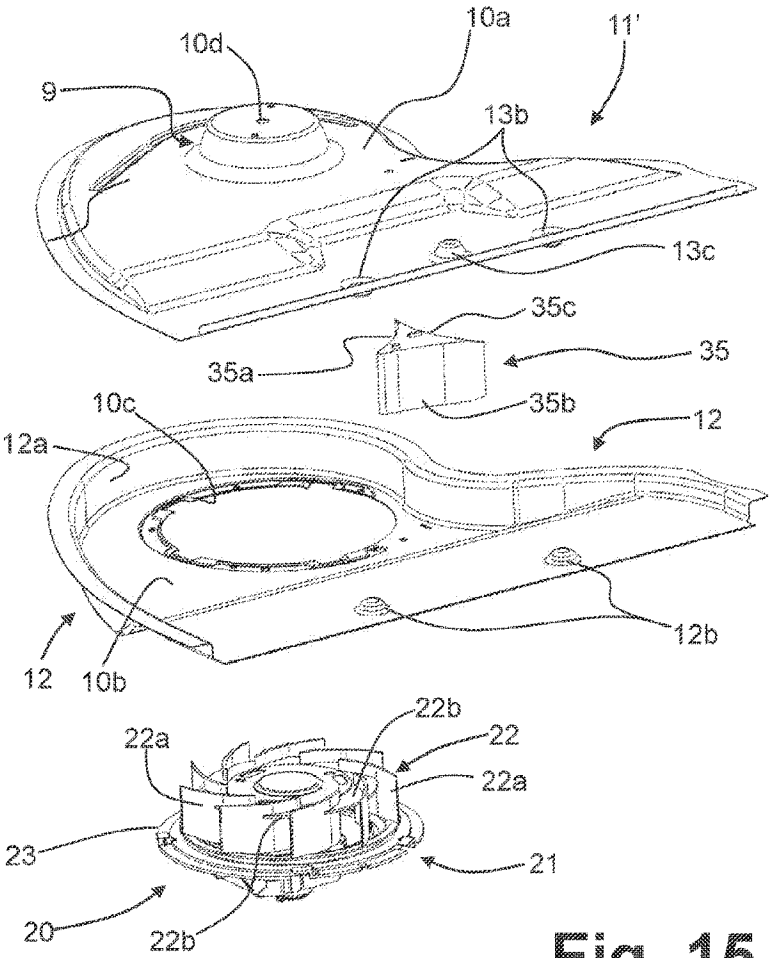
FIGS. 14 and 15 are views similar to those of FIGS. 9 and 10, but regarding a duct body with corresponding ventilation assembly according to a possible variant embodiment of the present invention.
Figure 14:
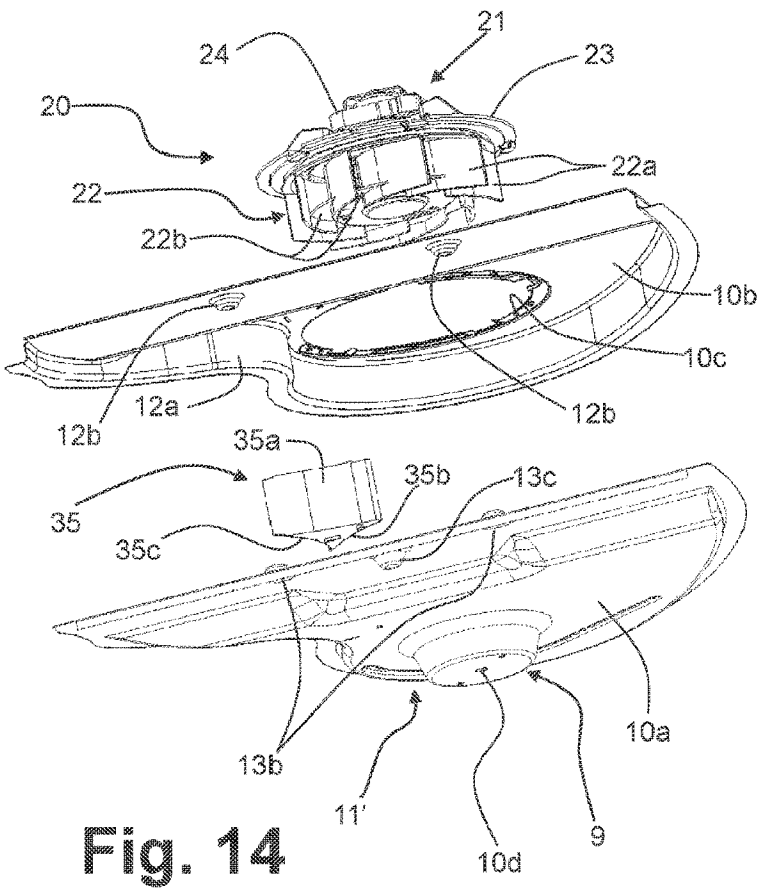

In this perspective, shown in FIGS. 14 and 15 is a variant embodiment of the duct body 10 in the case where it defines only the delivery channel. In these figures, the same reference numbers are used to designate elements that are technically equivalent to the ones already described above.

In the example embodiment, the duct body has in this case only the upper half-shell 12, already described previously, and a lower half-shell, designated here by 11', which has a configuration broadly corresponding to that of the intermediate wall 13 illustrated previously. The only substantial difference regards the presence of the corresponding lower drawn part 9, which is to form totally or partly the flue. In the case illustrated, the aforesaid lower drawn part 9 has a lower end portion—designed for coupling with the upper end portion of the upper drawn part 8 of the muffle 5—which is without the corresponding housing for a filtering element. It will be appreciated in any case that, if desired, such a housing can be directly made in the course of the operation of drawing of the part 9, as in the embodiment illustrated previously. It will be appreciated then that the production of a duct body including the delivery and intake channels and the production of a duct body including just the delivery channel implies for the most part similar operations, the only differences basically regarding the modalities of stamping/drawing of the half-shell 11' (on the other hand, it is clear that the die used to obtain the wall 13 can be appropriately tooled to obtain the half-shell 11').

From the foregoing description, the characteristics of the present invention emerge clearly, as do its advantages. It is likewise evident to a person skilled in the art that numerous variations may be made to the cooking appliance described by way of example herein, without thereby departing from the scope of the invention as defined by the ensuing claims.

We claim:

1. A household cooking appliance, in particular an oven, comprising a cooking chamber defined by a muffle having a flue with a fume outlet at an upper wall of the muffle, and a front door, for opening and closing the cooking chamber, the household cooking appliance also comprising:

a delivery channel, defined by a duct body that extends above the upper wall of the muffle, the duct body having an outlet of the delivery channel that is substantially at a front region of the household cooking appliance, above an upper portion of the front door, and having a fume inlet in a lower wall of the duct body, which is in fluid communication with the fume outlet of the muffle and with the delivery channel;

a ventilation assembly, operatively associated to the duct body so as to draw in fumes from the fume outlet of the muffle and expel them from the outlet of the delivery channel, the ventilation assembly being in a rear end region of the duct body that is generally opposite to the outlet of the delivery channel;

wherein the ventilation assembly comprises a radial fan with a centrifugal impeller thereof within the duct body, the centrifugal impeller having an axis and being positioned above the fume inlet of the duct body substantially coaxial thereto and to the fume outlet of the muffle in such a way that at least the fumes are drawn in from the fume outlet substantially in a direction of the axis of the centrifugal impeller and forced in a radial direction into the delivery channel for being expelled from the fume outlet;

wherein the rear end region of the duct body has a generally rounded peripheral profile so as to form a volute of the radial fan, the duct body preferably having a shape generally tapered towards the rear end region of the duct body and comprising a lower half-shell and an upper half-shell;

wherein inside the duct body, within boundaries of the delivery channel, a flow-deflector element is provided, configured for rendering a flow forced by the centrifugal impeller into the delivery channel uniform; and wherein the flow-deflector element has two converging side surfaces, a first side surface substantially forming a prolongation of a first generally concave stretch of a side of the duct body and a second side surface substantially forming a prolongation of a second generally concave stretch of the side of the duct body, the flow-deflector element being set up against the side in a generally convex transitional stretch thereof between the first generally concave stretch and the second generally concave stretch in a position comprised between the centrifugal impeller and the outlet of the delivery channel.

2. The household cooking appliance according to claim 1, wherein the duct body has at least one air intake in fluid communication with the delivery channel, the at least one air intake comprising at least one passage at an upper wall of the duct body; and the centrifugal impeller of the radial fan has an upper impeller section and a lower impeller section, prearranged for drawing in air from said at least one passage and the fumes from the fume outlet of the muffle, respectively, with a lower section of the centrifugal impeller being positioned above the fume inlet of the duct body substantially coaxial thereto and to the fume outlet of the muffle.

3. The household cooking appliance according to claim 2, wherein the radial fan has a structure for its support at an opening of an upper wall of the duct body that is substantially coaxial to the centrifugal impeller, at least one of said opening of the upper wall of the duct body and said structure defining said at least one passage.

4. The household cooking appliance according to claim 2, wherein the centrifugal impeller has a set of substantially radial blades with an upper edge and a lower edge, and one or more partitions that extend transversally with respect to the axis of the centrifugal impeller in an intermediate position with respect to the upper and lower edges of the set of substantially radial blades, for defining the upper and lower impeller sections of the centrifugal impeller.

5. The household cooking appliance according to claim 1, wherein the flue is formed from one or more of (A) a drawn part of the upper wall of the muffle that generally projects towards the lower wall of the duct body and (B) a drawn part of the lower wall of the duct body that generally projects towards the upper wall of the muffle.

6. The household cooking appliance according to claim 5, wherein the flue is formed from the drawn part of the lower wall of the duct body that generally projects towards the upper wall of the muffle, and the drawn part of the lower wall of the duct body includes the fume inlet.

7. The household cooking appliance according to claim 6, wherein the flue is further formed from the drawn part of the upper wall of the muffle that generally projects towards the lower wall of the duct body, and the drawn part of the upper wall includes the fume outlet.

8. The household cooking appliance according to claim 5, wherein the one or more of the drawn part of the upper wall of the muffle and the drawn part of the lower wall of the duct body that forms the flue houses a fume filtering element.

9. The household cooking appliance according to claim 7, wherein a fume filtering element is disposed between the drawn part of the lower wall of the duct body and drawn part of the upper wall of the muffle.

10. A household cooking appliance, in particular an oven, comprising a cooking chamber defined by a muffle having a flue with a fume outlet at an upper wall of the muffle, and a front door, for opening and closing the cooking chamber, the household cooking appliance also comprising:

a delivery channel, defined by a duct body that extends above the upper wall of the muffle, the duct body having an outlet of the delivery channel that is substantially at a front region of the household cooking appliance, above an upper portion of the front door, and having a fume inlet in a lower wall of the duct body, which is in fluid communication with the fume outlet of the muffle and with the delivery channel;

a ventilation assembly, operatively associated to the duct body so as to draw in fumes from the fume outlet of the muffle and expel them from the outlet of the delivery channel, the ventilation assembly being in a rear end region of the duct body that is generally opposite to the outlet of the delivery channel;

wherein the ventilation assembly comprises a radial fan with a centrifugal impeller thereof within the duct body, the centrifugal impeller having an axis and being positioned above the fume inlet of the duct body substantially coaxial thereto and to the fume outlet of the muffle in such a way that at least the fumes are drawn in from the fume outlet substantially in a direction of the axis of the centrifugal impeller and forced in a radial direction into the delivery channel for being expelled from the fume outlet;

wherein the rear end region of the duct body has a generally rounded peripheral profile so as to form a volute of the radial fan, the duct body preferably having a shape generally tapered towards the rear end region of the duct body and comprising a lower half-shell and an upper half-shell;

wherein inside the duct body, within boundaries of the delivery channel, a flow-deflector element is provided, configured for rendering a flow forced by the centrifugal impeller into the delivery channel uniform;

wherein the flow-deflector element has two converging side surfaces, a first side surface substantially forming a prolongation of a first generally concave stretch of a side of the duct body and a second side surface substantially forming a prolongation of a second generally concave stretch of the side of the duct body, the flow-deflector element being set up against the side in a generally convex transitional stretch thereof between the first generally concave stretch and the second generally concave stretch in a position comprised between the centrifugal impeller and the outlet of the delivery channel;

wherein the duct body has an upper wall and at least one intermediate wall which is set between, and generally faces, the lower and upper walls of the duct body, for defining in the duct body both the delivery channel and an intake channel that extends underneath the delivery channel;

wherein the intake channel has an inlet substantially at the upper portion of the front door, underneath the outlet of the delivery channel; and and wherein the at least one intermediate wall has an opening substantially coaxial to the centrifugal impeller in such a way that the radial fan draws into the delivery channel both the fumes from the fume outlet of the muffle and air from the inlet of the intake channel, to force a mixed fume/air flow into the delivery channel towards the outlet.

11. The household cooking appliance according to claim 10, wherein the front door comprises at least one outer door panel, one inner door panel, and one intermediate door panel, the door panels defining between them a plurality of gaps, amongst which at least an external gap and an internal gap, each having a lower inlet and an upper outlet, at a lower portion and an upper portion of the front door, respectively, for passage of a respective flow of cooling air.

12. The household cooking appliance according to claim 11 further comprising: a deflector mounted upon an upper end of one or more of the door panels that shield the inlet of the intake channel from the outlet of the delivery channel, in such a way that the air drawn in by the radial fan from the inlet of the intake channel comprises the cooling air exiting from the upper outlet of the internal gap.

13. The household cooking appliance according to claim 12, wherein the deflector shields the upper outlet of the internal gap from the upper outlet of the external gap in such a way that the aforesaid mixed fume/air flow from the outlet of the delivery channel produces a draught effect with respect to the external gap causing a difference of pressure between the lower inlet and the upper outlet of the external gap so as to induce the flow of cooling air into the external gap.

14. A household cooking appliance, in particular an oven, comprising a cooking chamber defined by a muffle having a flue with a fume outlet at an upper wall of the muffle, and a front door, for opening and closing the cooking chamber, the household cooking appliance also comprising:

a delivery channel, defined by a duct body that extends above the upper wall of the muffle, the duct body having an outlet of the delivery channel that is substantially at a front region of the household cooking appliance, above an upper portion of the front door, and having a fume inlet in a lower wall of the duct body, which is in fluid communication with the fume outlet of the muffle and with the delivery channel;

a ventilation assembly, operatively associated to the duct body so as to draw in fumes from the fume outlet of the muffle and expel them from the outlet of the delivery channel, the ventilation assembly being in a rear end region of the duct body that is generally opposite to the outlet of the delivery channel;

wherein the ventilation assembly comprises a radial fan with a centrifugal impeller thereof within the duct body, the centrifugal impeller having an axis and being positioned above the fume inlet of the duct body substantially coaxial thereto and to the fume outlet of the muffle in such a way that at least the fumes are drawn in from the fume outlet substantially in a direction of the axis of the centrifugal impeller and forced in a radial direction into the delivery channel for being expelled from the fume outlet;

wherein the rear end region of the duct body has a generally rounded peripheral profile so as to form a volute of the radial fan, the duct body preferably having a shape generally tapered towards the rear end region and comprising a lower half-shell and an upper half-shell;

wherein inside the duct body, within boundaries of the delivery channel, a flow-deflector element is provided, configured for rendering a flow forced by the centrifugal impeller into the delivery channel uniform;

wherein the flow-deflector element has two converging side surfaces, a first side surface substantially forming a prolongation of a first generally concave stretch of a side of the duct body and a second side surface substantially forming a prolongation of a second generally concave stretch of the side of the duct body, the flow-deflector element being set up against the side in a generally convex transitional stretch thereof between the first generally concave stretch and the second generally concave stretch in a position comprised between the centrifugal impeller and the outlet of the delivery channel; and wherein the front door comprises at least one outer door panel, one inner door panel, and one intermediate door panel, the door panels defining between them a plurality of gaps, amongst which at least an external gap and an internal gap, each having a lower inlet and an upper outlet, at a lower portion and an upper portion of the front door, respectively, for passage of a respective flow of cooling air.

15. The household cooking appliance according to claim 14, wherein:

the duct body has at least one air intake in fluid communication with the delivery channel, the at least one air intake comprising at least one passage at an upper wall of the duct body; and the centrifugal impeller of the radial fan has an upper impeller section and a lower impeller section, prearranged for drawing in air from said at least one passage and the fumes from the fume outlet of the muffle, respectively, the lower impeller section of the centrifugal impeller being positioned above the fume inlet of the duct body substantially coaxial thereto and to the fume outlet of the muffle.

16. The household cooking appliance according to claim 15, wherein the centrifugal impeller has a set of substantially radial blades with an upper edge and a lower edge, and one or more partitions that extend transversally with respect to the axis of the centrifugal impeller in an intermediate position with respect to the upper and lower edges of the set of substantially radial blades, for defining the upper and lower impeller sections of the centrifugal impeller.

17. The household cooking appliance according to claim 14 further comprising: a deflector mounted upon an upper end of one or more of the door panels that shield an inlet of an intake channel of the duct body from the outlet of the delivery channel, in such a way that air drawn in by the radial fan from the inlet of the intake channel comprises air exiting from the upper outlet of the internal gap.

18. The household cooking appliance according to claim 17, wherein the deflector shields the upper outlet of the internal gap from the upper outlet of the external gap in such a way that mixed fume/air flow from the outlet of the delivery channel produces a draught effect with respect to the external gap causing a difference of pressure between the lower inlet and the upper outlet of the external gap so as to induce a flow of cooling air into the external gap.

* * * * *